US006050677A

United States Patent [19]

Desie

[11] Patent Number: 6,050,677

[45] Date of Patent: Apr. 18, 2000

[54] METHOD FOR DIRECT ELECTROSTATIC PRINTING (DEP) A SUBSTRATE COMPRISING A CONDUCTIVE LAYER

[75] Inventor: Guido Desie, Herent, Belgium

[73] Assignee: Agfa-Gevaert, Mortsel, Belgium

[21] Appl. No.: 08/906,705

[22] Filed: Aug. 6, 1997

Related U.S. Application Data

[60] Provisional application No. 60/027,506, Sep. 27, 1996.

[30] Foreign Application Priority Data

Aug. 8, 1996 [EP] European Pat. Off. ..... 96202228

[51] Int. Cl.[7] ..... B41J 2/04

[52] U.S. Cl. ..... 347/55

[58] Field of Search ..... 347/55, 120, 141, 347/103, 154, 123, 140; 399/271, 290, 292, 293, 294, 295

[56] References Cited

U.S. PATENT DOCUMENTS 4,001,838 1/1977 Maddox ..... 346/153
5,305,026 4/1994 Kazuo et al. ..... 346/159
5,353,105 10/1994 Gundlach et al. ..... 355/279
5,781,217 7/1998 Desie ..... 347/55

FOREIGN PATENT DOCUMENTS 0675417 10/1995 European Pat. Off. .
0743572 11/1996 European Pat. Off. .
2238593 2/1975 France .

*Primary Examiner*—John Barlow
*Assistant Examiner*—Raquel Yvette Gordon
*Attorney, Agent, or Firm*—Baker Botts L.L.P.

[57] ABSTRACT

A method and apparatus is provided for a direct electrostatic printing on a substrate irrespective of the surface topology and conductivity of the substrate. A conductive layer is applied to a surface of the substrate to be printed. A voltage source is connected to establish a DC electric field between the conductive layer and a source of toner particles to create a flow of toner particles from the source to the surface of the substrate. A printhead structure is provided between the source and the substrate to image-wise modulate the flow of toner particles, and the toner particles are fixed on the substrate.

12 Claims, 1 Drawing Sheet

METHOD FOR DIRECT ELECTROSTATIC PRINTING (DEP) A SUBSTRATE COMPRISING A CONDUCTIVE LAYER

This application claims benefit of provisional application Ser. No. 60/027,506 filed Sep. 27, 1996.

DESCRIPTION

1. Field of the Invention

This invention relates to a method and an apparatus for use in the process of electrostatic printing and more particularly in Direct Electrostatic Printing (DEP). In DEP, electrostatic printing is performed directly from a toner delivery means on a substrate by means of an electronically addressable printhead structure.

2. Background of the Invention

In DEP (Direct Electrostatic Printing) the toner or developing material is deposited directly in an imagewise way on a receiving substrate, the latter not bearing any imagewise latent electrostatic image. In the case that the substrate is an intermediate endless flexible belt (e.g. aluminium, polyimide etc.), the imagewise deposited toner must be transferred onto another final substrate. If, however, the toner is deposited directly on the final receiving substrate, a possibility is fulfilled to create directly the image on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed in e.g. U.S. Pat. No. 3,689,935. This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures.

Each control electrode is formed around one aperture and is isolated from each other control electrode.

Selected potentials are applied to each of the control electrodes while a fixed potential is applied to the shield electrode. An overall applied propulsion field between a toner delivery means and an image receiving substrate projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode. The printing device as described in U.S. Pat. No. 3,689,935 is very sensitive to changes in distances from the toner application module towards said shield electrode, leading to changes in image density. Moreover, since the electrostatic characteristics of the final image receiving member are subject to changes in environmental conditions, the resulting image density is also dependent upon the environmental conditions. If a very thick isolating substrate is used as final image receptive member, then no density at all is possible using a printing device according to U.S. Pat. No. 3,689,935.

The problem of printing upon flat nonconducting image receiving members can be tackled by the introduction of an intermediate image receiving member. In e.g. U.S. Pat. No. 5,305,026, U.S. Pat. No. 5,353,105 and EP-A 743 572 a device is described comprising an intermediate recording medium upon which the toner image is jetted using a DEP-process, after which said toner image is transferred to a final receiving member by means of an electrostatic field. The toner is then fixed on said final receiving member. In the other embodiment said two processes are performed in a single step: i.e. the toner image is jetted upon a heated intermediate image receptive member from which the toner image is transferred and fused at the same time (transfused) to the final image receptive member. Since image transfer has to take place and high image quality with high image sharpness can only be obtained by using intimate contact between said final image receptive member and said intermediate image receptive member, said method of printing is only suitable for very flat final receptive members.

There is thus still a need for a DEP system yielding reliable and stable images of high image quality and sharpness upon final image receptive members having a moderate to high isolating power and a moderate to high surface irregularity.

3. Objects of the Invention

It is an object of the invention to provide an improved Direct Electrostatic Printing (DEP) method and device, printing high quality images (with a high density resolution and with a high spatial resolution) upon any final substrate, irrespective of its surface conductivity or surface topology.

It is a further object of the invention to provide a DEP method and device combining said high image quality on any substrate with good long term stability and reliability.

It is still a further object of the invention to provide a DEP method and device yielding said high image quality on any substrate at a high printing speed.

Further objects and advantages of the invention will become clear from the description hereinafter.

The above objects are realized by providing a method for direct electrostatic printing (DEP) on an insulating image receiving substrate, having a first and a second face, comprising the steps of:

- applying a conductive layer (112) upon said first face of said insulating substrate (109),
- connecting said conductive layer via a conductive charge applying device (105) to a voltage source, providing a DC field between said conductive layer and means for delivering toner particles, creating a flow of charged toner particles from said means for delivering toner particles to said conductive layer, interposing a printhead structure, having printing apertures and control electrodes around said printing apertures, between said means for delivering toner particles and said substrate, applying a voltage on said control electrodes for image wise controlling said flow of toner particles;

image wise depositing toner particles on said conductive layer on said substrate through said printing apertures and fixing said toner particles to said substrate.

Preferably said conductive layer has a surface resistance equal to or lower than $10^{14}$ Ω/square.

Preferably said conductive layer comprises an organic conductive compound.

The objects of the invention are further realized by providing a DEP device for printing on an insulating image receiving substrate, comprising:

means (111) for applying at least one conductive layer on said substrate, means (105) for providing a DC electrical field between means for delivering toner particles (101) and said conductive layer for creating a flow of charged toner particles from said means for delivering toner particles (101) to said conductive layer (112), a printhead (106) structure comprising printing apertures (107) and control electrodes **(106*a*), interposed between said means for delivering toner particles (101) and said conductive layer (112), a voltage source (V3) for applying a variable voltage on said control electrodes, for image wise modulating said flow of charged toner particles, and means (110)** for fixing said toner particles to said substrate.

DETAILED DESCRIPTION OF THE INVENTION

Figure 1:
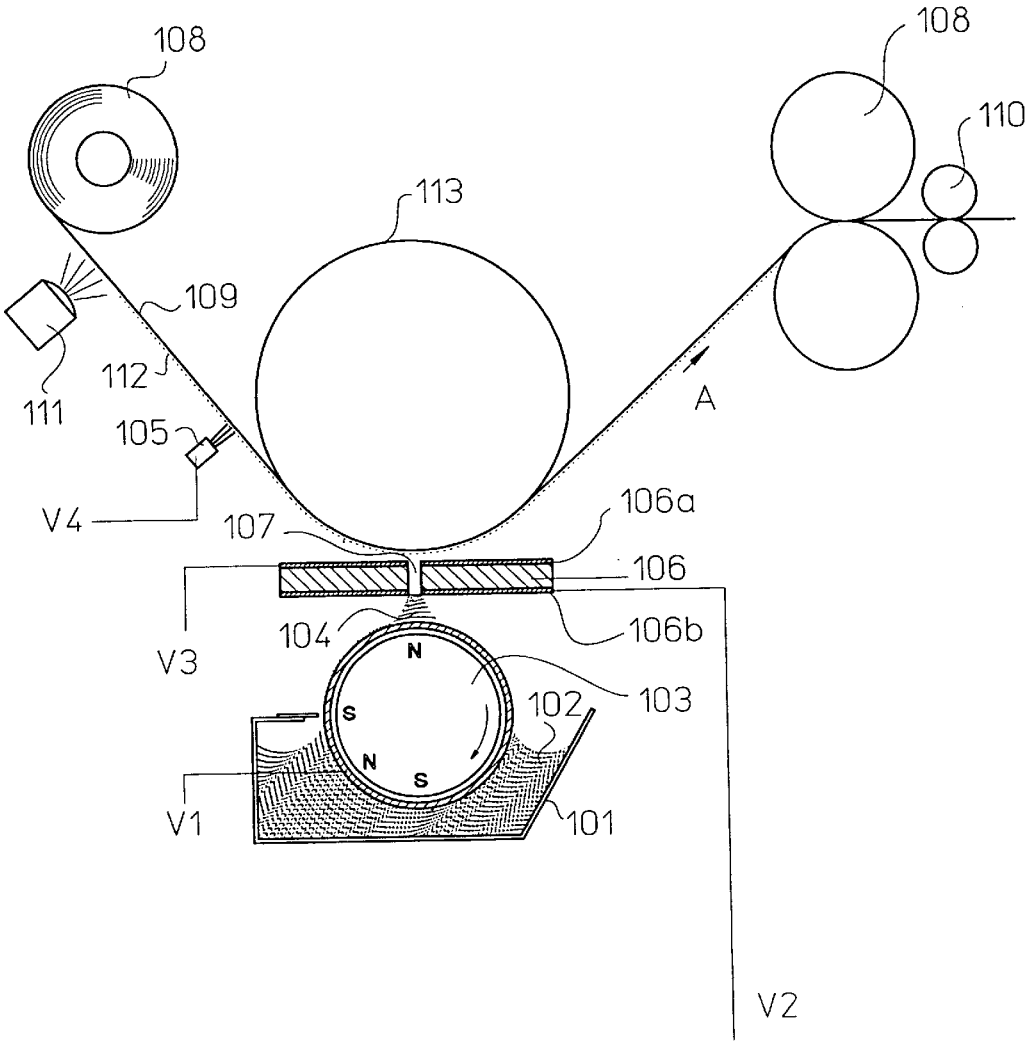
FIG. 1 is a schematic illustration of a possible embodiment of a DEP device according to the present invention.

In the literature many devices have been described that operate according to the principles of DEP (Direct Electrographic Printing). All these devices are able to perform grey scale printing either by voltage modulation or by time modulation of the voltages applied to the control electrodes. High quality images, however, can only be obtained in a direct way (i.e. without using an intermediate receiving member), if the final image receptive member shows sufficient conductivity. When printing on an insulating image receiving member, passing between a back electrode and a toner delivery means, the electrical field between the back electrode and the toner delivery means is weakened and only a very weak flow or even no flow at all of toner particles can be created between said back electrode and said toner delivery means, when applying reasonable DC voltages on the back electrode. Thus there is only a very low amount of toner particles that reaches the final image receiving substrate. The direct printing on insulating image receiving substrates is thus very difficult not to say impossible with prior art DEP devices. When the final image receiving member is conductive, the field applied between the toner delivery means (in this text the wording "toner delivery means" is used to describe "means for delivering charged toner particles") and the back electrode from these prior art devices, has a sufficient attractive force for the toner particles to be deposited upon said final image receptive member interposed between said printhead structure and said back electrode structure.

By using an intermediate image receptive member as described in e.g. U.S. Pat. No. 5,305,026, U.S. Pat. No. 5,353,105 and EP-A 743 572 it is possible to deposit an image upon said intermediate image receptive member, followed by transferring or transfusing said intermediate toner image to said final image receptive member. This final image receiving member can then be either conductive of insulating. In this case, however, the surface topography of said final image receptive member has to be such that intimate contact between said intermediate image receptive member and said final image receptive member is possible.

We have found that images with excellent image quality and sharpness can be obtained on any final image receptive member, irrespective of its surface topography and conductivity, by using a method as described in the object of the invention: i.e. treatment of said insulating final image receiving member (hereinafter called insulating substrate) before printing by applying a conductive layer on top of said substrate, contacting said conductive layer via a conductive charge applying device that is connected to a voltage source, and lastly printing images on said charged conductive layer. After fusing an image of excellent sharpness and quality is obtained upon said final image receiving member. Thus there is no back electrode needed in a method according to this invention and the DC field, for attracting charge toner particles from the toner delivery means to the final image receiving substrate is created between said toner delivery means and said conductive layer applied on said insulating substrate.

It was found that the printing on a substrate could proceed with good quality once the substrate was provided with a conductive layer having a surface resistance equal to or lower than $10^{14}$ Ω/square. In a preferred embodiment said conductive layer has a surface resistance equal to or lower than $10^{12}$ Ω/square, most preferred said surface resistance $\leqq 10^{10}$ Ω/square. Although the invention can be practised with any substrate to be printed, the invention can very beneficially be used for printing on an insulating substrate. In this invention insulating substrates are defined as substrates that are at least 200 μm thick (even plain paper with such a thickness is insulating in the sense of this document) or that are plastics, e.g. polyesters, addition polymers (polyvinylchloride, polypropylene, polystyrene, etc), polycarbonates, etc.

The surface resistance expressed in Ω/square (ohm/sq.) of the above defined conductive layer is measured according to test procedure A as follows:

after coating, the resulting conductive layer is dried and conditioned at a specific relative humidity (R.H.) and temperature. The surface resistance expressed in ohm per square (Ω/square) is performed by placing onto the outermost layer two conductive poles having a length of 10 cm parallel to each other at a distance of 1 cm and measuring the resistance built up between the electrodes with a precision ohm-meter (ref. DIN 53482). The values of surface resistance mentioned in the present invention are measured at a temperature between 18 and 25° C. and at a relative humidity (RH) between 40 and 60%.

Said conductive layer can be applied either off-line (i.e. outside of the printing device) or on-line in a "conductive layer applying station" incorporated in the printing device.

The present invention includes thus a method for DEP printing comprising the steps of:

i) applying a conductive layer (112) upon a substrate (109), ii) connecting said conductive layer via a conductive charge applying device (105) to a voltage source, iii) providing a DC field between said conductive layer and a toner delivery means (101), iv) image wise depositing toner particles upon said conductive coating (112), said toner particles being deposited via a printhead structure (106) containing individual control electrodes **(106*a*) in combination with printing apertures (107)**.

The conductive layer can, in the methods according to this invention, be applied on top of said insulating substrate by any means known in the art. It can be coated, sprayed, brushed, etc, on said insulating substrate. When the application of said conductive layer proceeds on-line, it is preferred to spray coat it. The application of said conductive layer proceeds preferably from a dilute composition (solution, emulsion, dispersion, polymeric latex, etc) comprising conductive compounds. Any conductive compound known to those skilled in the art can be used in the method of the present invention. Said conductive compounds can be particulate materials such as small conductive beads (e.g, iron beads) conductive anorganic material (e.g. $SnO_2$, $V_2O_5$, etc), conducting polymers both ionically and electronically conductive or a mixture of both.

Preferred conductive compounds for use according to the present invention are transparent or semi-transparent conductive polymers.

Examples of preferred ionically conducting polymers are acidic polymers, preferably polymeric carboxylic or sulphonic acids. Examples of such polymeric acids are polymers containing repeating units selected from the group consisting of acrylic acid, methacrylic acid, maleic acid, vinyl sulphonic acid and styrene sulphonic acid or mixtures thereof. Polymers of this type, useful in the present invention have been disclosed in e.g. U.S. Pat. No. 5,254,448, U.S. Pat. No. 5,4045,441 and EP-A 437 728. Polyesters comprising moieties comprising sulphonic acid group (e.g., a polyester comprising moieties derived from sulphoisophthalic acid) are also useful within the present invention.

Examples of preferred electronically conductive polymers are polyaniline, polypyrrole, polythiophene, etc. Preferred electronically conductive polymers are polythiophenes. Useful polythiophenes have been described in, e.g. EP-A 203 438, EP-A 253 594, EP-A 257 573, U.S. Pat. No. 4,929,383 and EP-A 505,955. Preferred, for use in the present invention, among the electronically conductive polymers is a polythiophene with conjugated polymer backbone in the presence of a polymeric polyanion compound. Further preferred is a polythiophene having structural units corresponding to the following formula I:

Formula I

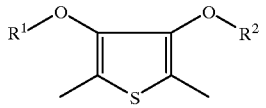

in which:

each of $R^1$ and $R^2$ independently represents hydrogen or a $C_{1-4}$ alkyl group or together represent an optionally substituted $C_{1-4}$ alkylene group or a cycloalkylene group. Such polythiophene has been disclosed in e.g. EP-A 339 340, U.S. Pat. No. 4,910,645 and U.S. Pat. No. 5,300,575. The synthesis of such a polythiophene proceeds in the presence of polymeric polyanion compounds by oxidative polymerization of 3,4-dialkoxythiophenes or 3,4-alkylenedioxythiophenes according to formula II:

Formula II

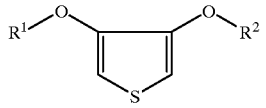

in which $R^1$ and $R^2$ are as defined in formula I, with oxidizing agents typically used for the oxidative polymerization of pyrrole and/or with oxygen or air in the presence of said polyacids, preferably in aqueous medium containing optionally a certain amount of organic solvents, at temperatures of 0 to 100° C.

Oxidizing agents suitable for the oxidative polymerization of pyrrole are described, for example, in J. Am. Soc. 85, 454 (1963). Inexpensive and easy-to-handle oxidizing agents are preferred such as iron(III) salts, e.g. $FeCl_3$, $Fe(ClO_4)_3$ and the iron(III) salts of organic acids and inorganic acids containing organic residues, likewise $H_2O_2$, $K_2Cr_2O_7$, alkali or ammonium persulfates, alkali perborates, potassium permanganate and copper salts such as copper tetrafluoroborate.

Theoretically, 2.25 equivalents of oxidizing agent per mol of thiophene are required for the oxidative polymerization thereof [ref. J. Polym. Sci. Part A, Polymer Chemistry, Vol. 26, p.1287 (1988)]. In practice, however, the oxidizing agent is used in a certain excess, for example, in excess of 0.1 to 2 equivalents per mol of thiophene.

Suitable polymeric polyanion compounds for use in the presence of said polythiophenes are provided by acidic polymers in free acid or neutralized form. The acidic polymers are preferably polymeric carboxylic or sulphonic acids. Examples of such polymeric acids are polymers containing repeating units selected from the group consisting of acrylic acid, methacrylic acid, maleic acid, vinyl sulphonic acid and styrene sulphonic acid or mixtures thereof. The anionic (acidic) polymers used in conjunction with the dispersed polythiophene polymer have preferably a content of anionic groups of more than 2% by weight with respect to said polymer compounds to ensure sufficient stability of the dispersion. Suitable acidic polymers or corresponding salts are described e.g. in DE-A-25 41 230, DE-A-25 41 274, DE-A-28 35 856, EP-A-14 921, EP-A-69 671, EP-A-130 115, U.S. Pat. No. 4,147,550, U.S. Pat. No. 4,388,403 and U.S. Pat. No. 5,006,451.

The polymeric polyanion compounds may consist of straight-chain, branched chain or cross-linked polymers. Cross-linked polymeric polyanion compounds with a high amount of acidic groups are swellable in water and are named microgels. Such microgels are disclosed e.g. in U.S. Pat. No. 4,301,240, U.S. Pat. No. 4,677,050 and U.S. Pat. No. 4,147,550. A preferred polyanion compound for combining with a polythiophene in order to provide a solution to apply a conductive layer according to this invention, is polystyrenesulphonic acid.

Using conductive polymers with very low light absorption (preferably clear, transparent polymers are used) are applied then the characteristics of the final image receptive substrate are not changed. This is very interesting in case an additional image is printed using said DEP method upon a final image receptive member (the insulating substrate) that already has some image information. The word "clear" means herein not giving, in a wavelength range extending from 400 to 700 nm, a visible density, said visible density being defined as less than 15% light reduction integrated over that wavelength range.

The composition for applying a thin transparent conductive layer upon said insulating substrate, can comprise any solvent, binder and additives (e.g. preservatives, viscosity regulators, surfactants, etc) known in the art. The properties of said composition for applying a thin transparent conductive layer upon said insulating substrate can be adapted to the chemical and physical properties of the insulating substrate on which the image has to be printed. Depending upon the chemical and physical properties of said insulating substrate, said composition can comprise solvents ranging from water, ethanol, propanol, MEK, toluene, etc. Binders can be added so that an homogeneous coating thickness can be obtained upon said final image receptive member (insulating substrate). Examples of suitable binders for use in the method according to the present invention are, e.g., polyvinylalcohol, carboxymethylcellulose, polyvinylpyrrolidone, polyacrylamide, gelatine, copolyesters, etc. As viscosity regulators any material known to those skilled in the art can be used. The surface tension of said composition can be tuned by the incorporation of any surfactant known to those skilled in the art, and includes anionic, cationic or non-ionic tensides. The composition for applying a thin transparent conductive layer upon said insulating substrate can further, if desired, comprise filler material such as fine particles, UV-absorbers, anti-foam additives, etc. A very suitable composition for a conductive layer according to the present invention has been described in U.S. Pat. No. 5,391,472, that is incorporated herein by reference. In this document a transparent antistatic layer, wherein said layer contains (1) a polythiophene with conjugated polymer backbone in the presence of a polymeric polyanion compound and (2) at least one latex polymer having hydrophilic functionality has been disclosed.

By "latex polymer" is understood a polymer or copolymer that is applied as an aqueous dispersion (latex) of particles of said polymer or copolymer. By "hydrophilic functionality" is meant a chemical group having affinity for water e.g. a sulphonic acid or carboxylic acid group preferably in salt form e.g. an alkali metal salt group. The "latex polymer" applied in admixture with said polythiophene and polymeric anion compound is preferably a copolyester containing sulphonic acid groups in salt form, but other polyesters, such as the copolyesters having hydrophilic functionality as described e.g. in U.S. Pat. Nos. 3,563,942, 4,252,885, 4,340,519, 4,394,442 and 4,478,907, may be used likewise.

Preferred copolyesters contain a certain amount of sulphonic acid groups in salt form (ref. GB-P 1,589,926) and as described in U.S. Pat. No. 4,478,907 and EP 78 559 and for raising their glass transition temperature (Tg) contain an amount of particular co-condensated cross-linking agent(s). Such copolyesters contain e.g. recurring ester groups derived from ethylene glycol and an acid mixture containing (i) terephthalic acid, (ii) isophthalic acid, (iii) 5-sulphoisophthalic acid whose sulpho group is in salt form and (iv) a polyfuctional acid producing cross-links.

In a particularly preferred embodiment the copolyester is a copolyester containing recurring ester groups derived from ethylene glycol and an acid mixture containing terephthalic acid, isophthalic acid and 5-sulphoisophthalic acid whose sulpho group is in salt form, said acid mixture consisting essentially of from 20 to 60 mole % of isophthalic acid, 6 to 10 mole % of said sulphoisophthalic acid, 0.05 to 1 mole % of cross-linking agent being an aromatic polycarboxylic acid compound having at least three carboxylic acid groups or corresponding acid generating anhydride or ester groups, the remainder in said acid mixture being terephthalic acid.

The present invention comprises also a DEP device for printing on an insulating image receiving substrate, comprising:

means (111) for applying at least one conductive layer on said substrate, means (105) for providing a DC electrical field between means for delivering toner particles (101) and said conductive layer for creating a flow of charged toner particles from said means for delivering toner particles (101) to said conductive layer (112), a printhead (106) structure comprising printing apertures (107) and control electrodes **(106*a*), interposed between said means for delivering toner particles (101) and said conductive layer (112), a voltage source (V3) for applying a variable voltage on said control electrodes, for image wise modulating said flow of charged toner particles, and means (110)** for fixing said toner particles to said substrate.

Said conductive layer is a conductive layer having a conductivity and composition as described herein before. Said substrate can be any substrate, but the invention is well suited to be used for printing an insulating substrate. The substrate can have any shape, e.g., it can be in sheet form, in web form, it can be moulded articles, etc. When the substrate is a moulded article, it can have any shape and any surface topology. It can e.g. be cylindrical with a smooth surface, it can be flat with a ondulated surface, etc.

Said means for applying said conductive layer on said substrate can be any means known in the art to apply a composition comprising a conductive compound (conductive composition) on a substrate. Said means for applying said conductive composition can be rollers, wicks, sprays, etc. When said means for applying said conductive composition are rollers, it may be split rollers. Very suitable means for applying said conductive composition are supply rollers with a surface in NOMEX-felt (NOMEX is a trade name of Du Pont de Nemours, Wilmington, US) as described in article titled "Innovative Release Agent Delivery Systems" by R. Bucher et al. in The proceedings of IS&T's Eleventh International Congress on Advances in Non-Impact Printing Technologies, page 219–222. This congress was held in Hilton Head, from 29.10.95 to 03.11.95. The proceedings are published by IS&T, Springfield, US 1995. The conductive composition can be delivered to the image directly by supply rollers as described above, or over an intermediate roller, which distributes the composition even more evenly over the substrate.

Other well suited means for applying said conductive composition are spraying means, e.g. an air-brush. Such an air brush is preferred when the substrate to be printed is a moulded article, showing a relief surface. By using an air-brush, even on such uneven surfaces, an even layer of conductive material can be applied.

Said means for applying an electrical field between said conductive layer and a toner delivery means, comprise means for contacting said conductive layer and connecting it to an appropriate voltage source or to the earth. Said means for contacting said conductive layer comprise preferably a conductive brush. The hairs of said brush can be metallic fibres, carbon fibres, etc. When using a conductive brush it is preferred that said brush contacts said conductive layer only at one or more of the edges of the surface to be printed. Since said brush when only contacting edges of the surface to be printed, it does not touch the image parts, that can be made up with not yet fused or fixed toner particles, so the device according to the present invention can be used for printing multiple images (multiple monochrome image or multiple images (e.g. a yellow, magenta, cyan and black image) to form a full colour image on top of each other and fixing all layers of deposited toner particles at once.

The means for contacting said conductive layer can also be contacting rollers made of conductive material, preferably metal as aluminum, stainless steel. When using a roller it is preferred that the surface of such a roller is formed by a conductive elastomeric compound, e.g., by a rubber filled with carbon black.

A non limitative example of a device for implementing a DEP method according to the present invention is shown in FIG. 1 and comprises:

(i) a toner delivery means (101), comprising a container for developer (102) and a magnetic brush assembly (103), this magnetic brush assembly forming a cloud (104) of toner particles (ii) a printhead structure (106), made from a plastic insulating film, coated on both sides with a metallic film. The printhead structure (106) comprises one continuous electrode surface, hereinafter called "shield electrode" (106*b*) facing in the shown embodiment the toner delivering means and a complex addressable electrode structure, hereinafter called "control electrode" (106*a*) around printing apertures (107), facing, in the shown embodiment, the toner receiving member in said DEP device, (the location and/or form of the shield electrode (106*b*) and the control electrode (106*a*) can, in other embodiments of a device for a DEP method, be different from the location shown in FIG. 1)

(iii) conveyer means (108) to convey a final image receptive member (109) for said toner under said printhead structure in the direction indicated by arrow A (iv) a spraying device (111) applying a thin conductive layer of a conductive solution (112) upon the front side of said final image receptive member (109)

(v) a conductive charge applying device (105) contacting said conductive layer upon said final image receptive member via its conductive hairs (vi) means for fixing (110) said toner onto said final image receptive member.

vii) means (113) for supporting said substrate in the neighbourhood of said printhead structure.

Between said printhead structure (106) and the magnetic brush assembly (103) as well as between the control electrode around the printing apertures (107) and the conductive charge applying device (105) contacting the conductive layer upon the toner receiving member (109) as well as on the single electrode surface or between the plural electrode surfaces of said printhead structure (106) different electrical fields are applied. In the specific embodiment of a device, useful for a DEP method, shown in FIG. 1. voltage V1 is applied to the sleeve of the magnetic brush assembly 103, voltage V2 to the shield electrode 106*b*, voltages $\mathbf{V3}_0$ up to $\mathbf{V3}_n$ for the control electrode (106*a*). The value of V3 is selected, according to the modulation of the image forming signals, between the values $\mathbf{V3}_0$ and $\mathbf{V3}_n$, on a timebasis or grey-level basis. Voltage V4 is applied to the conductive charge applying device. In other embodiments of the present invention multiple voltages $\mathbf{V2}_0$ to $\mathbf{V2}_n$ can be used.

The magnetic brush assembly (103) preferentially used in a DEP device according to an embodiment of the present invention can be either of the type with stationary sleeve and rotating core or of the type with rotating core and rotating sleeve.

Several types of carrier particles, such as described in EP-A 675,417 can be used in a preferred embodiment of the present invention.

Any kind of two-component toner particles, black, coloured or colourless, can be used in a DEP device according to the present invention. It is preferred to use toner particles as disclosed in EP-A 715 218, that is incorporated by reference.

A DEP device making use of the above mentioned marking particles can be addressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the voltage V3 applied on the control electrode 106*a* or by a time modulation of V3. By changing the duty cycle of the time modulation at a specific frequency, it is possible to print accurately fine differences in grey levels. It is also possible to control the grey level printing by a combination of an amplitude modulation and a time modulation of the voltage V3, applied on the control electrode.

The combination of a high spatial resolution, obtained by the small-diameter printing apertures (107), and of the multiple grey level capabilities typical for DEP, opens the way for multilevel halftoning techniques, such as e.g. described in the EP-A 634 862. This enables the DEP device, according to the present invention, to render high quality images.

EXAMPLES

The Printhead Structure

A printhead structure (106) was made from a polyimide film of 50 μm thickness, double sided coated with a 9 μm thick copper film. The printhead structure (106) had four rows of printing apertures. On the back side of the printhead structure, facing the receiving member substrate, a square shaped control electrode (106*a*) was arranged around each aperture. Each of said control electrodes was individually addressable from a high voltage power supply. On the front side of the printhead structure, facing the toner delivery means, a common shield electrode (106*b*) was present. The printing apertures had an aperture diameter of 100 μm. The total width of the square shaped copper control electrodes was 250 μm, their internal aperture width was also 100 μm. The width of the aperture in the common shield electrode was 400 μm. Said printhead structure was fabricated in the following way. First of all the control electrode pattern was etched by conventional copper etching techniques. Then the shield electrode pattern was etched by conventional copper etching techniques. The apertures were made by a step and repeat focused excimer laser making use of the control electrode patterns as focusing aid. After excimer burning the printhead structure was cleaned by a short isotropic plasma etching cleaning. Finally a thin coating of PLASTIK70 (tradename), commercially available from Kontakt Chemie, was applied over the control electrode side of said printhead structure.

The Toner Delivery Means

The toner delivery means (101) was a stationary core/rotating sleeve type magnetic brush.

The magnetic brush assembly (103) was constituted of the so called magnetic roller, which in this case contained inside the roller assembly a magnetic core, showing 9 magnetic poles of 500 Gauss magnetic field intensity with a fall-off zone. The magnetic roller contained also a sleeve, fitting around said magnetic core, and giving to the magnetic brush assembly an overall diameter of 20 mm. The sleeve was made of finely roughened stainless steel. A doctoring blade was used to meter a small amount of developer onto the surface of said magnetic brush assembly. The sleeve was rotating at 100 rpm. The magnetic brush assembly (103) was connected to an AC power supply with a square wave oscillating field of 600 V at a frequency of 3.0 kHz with 0 V DC-offset.

The Developer i) Carrier particles

A macroscopic "soft" ferrite carrier consisting of a MgZn-ferrite with average particle size 50 $\mu$m, a magnetisation at saturation of 29 emu/g was provided with a 1 $\mu$m thick acrylic coating. The material showed virtually no remanence.

ii) The toner particles

The toner used for the experiment had the following composition: 97 parts of a co-polyester resin of fumaric acid and propoxylated bisphenol A, having an acid value of 18 and volume resistivity of $5.1\times10^{16}$ ohm·cm was melt-blended for 30 minutes at 110° C. in a laboratory kneader with 3 parts of Cu-phthalocyanine pigment (Colour Index PB 15:3). A resistivity decreasing substance—having the following structural formula: $(CH_3)_3N^+C_{16}H_{33}Br^-$—was added in a quantity of 0.5% with respect to the binder. It was found that—by mixing with 5% of said ammonium salt—the volume resistivity of the applied binder resin was lowered to $5\times10^{14}$ Ω·cm.

After cooling, the solidified mass was pulverized and milled using an ALPINE Fliessbettgegenstrahlmuhle type 100AFG (tradename) and further classified using an ALPINE multiplex zig-zag classifier type 100 MZR (tradename). The resulting particle size distribution of the separated toner, measured by Coulter Counter model Multisizer (tradename), was found to be 6.3 $\mu$m average by number and 8.2 $\mu$m average by volume. In order to improve the flowability of the toner mass, the toner particles were mixed with 0.5% of hydrophobic colloidal silica particles (BET-value 130 $m^2/g$).

An electrostatographic developer was prepared by mixing said mixture of toner particles and colloidal silica in a 4% ratio (w/w) with carrier particles. The tribo-electric charging of the toner-carrier mixture was performed by mixing said mixture in a standard tumbling set-up for 10 min. The developer mixture was run in the development unit (magnetic brush assembly) for 5 minutes, after which the toner was sampled and the tribo-electric properties were measured, according to a method as described in the above mentioned EP-A 675 417, giving q=−7.1 fC, q as defined in said EP-A.

The Printing Device

The distance l between the front side of the printhead structure (106) and the sleeve of the magnetic brush assembly (103), was set at 450 $\mu$m. The distance between the surface of the substrate (109) to be printed and the back side of the printhead structure (106) (i.e. control electrodes 106*a*) was set to 500 $\mu$m and the substrate travelled at 1 cm/sec. To the individual control electrodes an (imagewise) voltage V3 between 0 V and −300 V was applied. The shield electrode was grounded: V2=0 V.

Example 1

On a sheet of polyester of thickness A $\mu$m, a conductive coating was applied by an air brush (111) that sprayed a thin coating of a composition comprising a conductive polymer. Said composition consisted of (all parts in weight):

40 parts of acetone, 50 parts of methanol, 1 part of polyvinylalcohol, 4 parts of water and 5 parts of a polythiophene/polyanion mixture (PEDT). The latter mixture (dispersion) was prepared as follows:

Into 1000 ml of an aqueous solution of 7 g of polystyrene sulphonic acid (109 mmol of $SO_3H$ groups) with number-average molecular weight (Mn) 40,000, were introduced 12.9 g of potassium peroxidisulfate ($K_2S_2O_8$), 0.1 g of $Fe_2(SO_4)_3$ and 2.8 g of 3,4-ethylenedioxy-thiophene. The thus obtained reaction mixture was stirred for 24 h at 20° C. and subjected to desalting. The above prepared reaction mixture was stirred for 6 hours at room temperature in the presence of a granulated weak basic ion exchange resin LEWATIT H 600 (tradename of the Bayer Company of Leverkusen, Gemany) and strongly acidic ion exchanger LEWATIT S 100 (tradename of the Bayer Company of Leverkusen, Germany). After said treatment the ion exchange resins were filtered off and the potassium ion and sulphate ion content were measured which were respectively 0.4 g $K^+$ and <0.1 g $(SO_4)^{2-}$ per litre. The means for providing an electrical field between the conductive layer and the toner delivery means was a brush with carbon-black filled conductive hairs and was placed at 50 mm from the printing nip. Said brush (105) was connected to a high voltage power supply of +1500 V. To the sleeve of the magnetic brush an AC voltage of 600 V at 3.0 kHz was applied, without DC offset.

Examples 2–4

A printing configuration as described in example 1 was used, except for the fact that as substrate, polyester foil with typical photographic subbing layers (Example 2), a polycarbonate foil (Example 3), and a PVC foil (Example 4) was used.

Example 5

The procedure of example 1 was repeated, except for the fact that as substrate a linoleum foil with carpet design was used and that instead of PEDT a commercially available conductive spray (ANTISTATIC 100, tradename of Kontakt Chemie) was used.

Comparative Examples CE1–CE4

For comparative examples C1 and C2 the same configuration as described in example 1 was used except for the fact that the conductive brush (105) was grounded. In comparative example CE1 polyester foil was used as substrate as described in example 1, in comparative example 2 the same substrate as described in example 5 was used. In comparative examples 3 and 4 the same configuration as described in examples 1 and 5 was used, except for the fact that no conductive layer was applied to said substrates.

Grey scale images with 16 time-modulated levels were printed with all configurations as tabulated in table 1. The image quality and sharpness was measured as the width of a final image part compared to the width of the nozzle zone in said printhead structure used to print said image. Excellent sharpness was rated 1, rating 4 to 5 indicated very bad sharpness to no density at all.

TABLE 1

| Sample | Conductive coating | Applied voltage | Print quality |
|---|---|---|---|
| E1 | PEDT | 1500 | 1 |
| E2 | PEDT | 1500 | 1 |
| E3 | PEDT | 1500 | 1 |
| E4 | PEDT | 1500 | 1 |
| E5 | AS100 | 1500 | 1 |
| CE1 | PEDT | 0 | 5 |
| CE2 | PEDT | 0 | 5 |
| CE3 | NO | 1500 | 5 |
| CE4 | NO | 1500 | 4 |

From table 1 it is clear that the examples according to the present invention can offer an excellent solution to the problem of low density and low sharpness in DEP devices printing upon thick irregularly shaped non-conductive substrates.

Examples 6–13

In the examples 6 to 8, the conductive composition as described in example 1 is applied off-line to a 300 $\mu$m polyethyleleneterephthalate film, in various thicknesses so as to provide substrates with varying lateral resistance. On the various substrate, printing proceeded with a DEP device as described in example 1. The sharpness and the maximum optical density reached were evaluated as described above. The results, together with the lateral resistance (Ω/square) are given in table 2.

TABLE 2

| Example # | Lateral resistance Ω/ square | Printing quality |
|---|---|---|
| 6 | $10^{16}$ | 5 |
| 7 | $2\ 10^{14}$ | 3–4 |
| 8 | $2\ 10^{13}$ | 2–3 |
| 9 | $2\ 10^{10}$ | 1 |
| 10 | $10^{8}$ | 1 |
| 11 | $10^{7}$ | 1 |
| 12 | $10^{6}$ | 1 |
| 13 | $10^{2}$ | 1 |

It must be clear to those skilled in the art that alterations can be made to this concept of printing without departing from the spirit of the present invention. It must be clear that any method of charging the surface of a non-conducting receptive member can be used according to the same object of the present invention. Surface charging can e.g. be performed by charged contact rollers, corona or scorotron devices, frictional contact charging means, etc. . .

What is claimed is:

1. A method for DEP printing on a surface of an image receiving substrate irrespective of surface topology and conductivity of said substrate, comprising the steps of:

applying a conductive layer upon said surface of said substrate;

connecting said conductive layer by a conductive charge applying device to a voltage source;

providing a DC field between said conductive layer and a source of toner particles, creating a flow of charged toner particles from said source of toner particles to said conductive layer;

interposing a printhead structure, having printing apertures and control electrodes around said printing apertures, between said source of toner particles and said substrate;

applying a voltage on said control electrodes for image wise controlling said flow of toner particles;

image wise depositing toner particles on said conductive layer on said surface of said substrate through said printing apertures and fixing said toner particles to said substrate.

2. A method according to claim 1, wherein said conductive layer is applied to have a surface resistance lower than or equal to $10^{14}$ Ω/square.

3. A method according to claim 1, wherein said conductive layer is applied to have a surface resistance lower than or equal to $10^{12}$ Ω/square.

4. A method according to claim 1, wherein said applying step comprises applying an organic conductive compound.

5. A method according to claim 4, wherein said applying step comprises applying a polymeric compound having ionic conductivity.

6. A method according to claim 4, wherein said applying step comprises applying a polymeric compound having electronic conductivity.

7. A method according to claim 6, wherein said applying step comprises applying a polythiophene with conjugated polymer backbone in the presence of a polymeric polyanion compound.

8. A method according to claim 7, wherein said applying step comprises applying a polythiophene having structural units corresponding to the following formula:

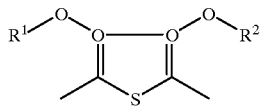

in which:

each of $R^1$ and $R^2$ independently represents hydrogen or a $C_{1-4}$ alkyl group or together represent an optionally substituted $C_{1-4}$ alkylene group or a cycloalkylene group.

9. A DEP device for printing on a surface of an image receiving substrate irrespective of surface topology and conductivity of said substrate, comprising an applicator for applying at least one conductive layer on said surface of said substrate;

a first voltage source connected to provide a DC electrical field between a source of toner particles and said at least one conductive layer for creating a flow of charged toner particles from said source of toner particles to said conductive layer;

a printhead structure, having printing apertures and control electrodes, interposed between said source of toner particles and said conductive layer;

a second voltage source for selectively applying a voltage on said control electrodes, for image wise modulating said flow of toner particles; and a fixing station for fixing said toner particles to said substrate.

10. A DEP device according to claim 9 wherein said applicator includes an air brush.

11. A DEP device according to claim 9, wherein said first voltage source includes a conductive brush.

12. A DEP device according to claim 9, wherein said first voltage source includes a conductive roller.

* * * * *